US007104643B2

(12) United States Patent
Glass et al.

(10) Patent No.: US 7,104,643 B2
(45) Date of Patent: Sep. 12, 2006

(54) USING CONTINUOUS SPRAY INKJET SYSTEM FOR ACCURATELY PRINTING TITANIUM OXIDE BASED INKS

(75) Inventors: Boaz Glass, Modi'in (IL); Murray Figov, Ra'anana (IL)

(73) Assignee: Creo Il. Ltd., Herzlia (IL)

( * ) Notice: Subject to any disclaimer, the term of this patent is extended or adjusted under 35 U.S.C. 154(b) by 0 days.

(21) Appl. No.: 11/123,737

(22) Filed: May 6, 2005

(65) Prior Publication Data

US 2005/0264632 A1 Dec. 1, 2005

Related U.S. Application Data

(63) Continuation of application No. PCT/IL03/00922, filed on Nov. 6, 2003.

(60) Provisional application No. 60/425,905, filed on Nov. 13, 2002.

(51) Int. Cl.
*B41J 2/01* (2006.01)

(52) U.S. Cl. ..... 347/105; 347/21; 347/98; 347/100

(58) Field of Classification Search ..... None
See application file for complete search history.

(56) References Cited

U.S. PATENT DOCUMENTS

| | | | | |
|---|---|---|---|---|
| 5,660,962 | A * | 8/1997 | Malhotra et al. | 430/97 |
| 5,821,956 | A * | 10/1998 | Kroon et al. | 347/43 |
| 6,084,621 | A * | 7/2000 | Shioya | 347/101 |
| 6,135,654 | A | 10/2000 | Jennel | |

FOREIGN PATENT DOCUMENTS

| | | |
|---|---|---|
| DE | 100 51 088 A1 | 1/2002 |
| JP | 01123671 | 5/1989 |
| JP | 09141841 | 3/1997 |

* cited by examiner

*Primary Examiner*—Thinh Nguyen

(57) ABSTRACT

Method and apparatus for producing an accurately positioned white layer to serve as an undercoat for inkjet process colors imaging on a substrate, by accurately ink jetting a colorless loosely-bonded frame onto the substrate, thereby defining an area to be imaged, ink jetting or spraying a white layer, the white layer at least partially overlapping the frame and covering the area defined by the frame.

10 Claims, 3 Drawing Sheets

USING CONTINUOUS SPRAY INKJET SYSTEM FOR ACCURATELY PRINTING TITANIUM OXIDE BASED INKS

This application is a continuation of PCT International Application No. PCT/IL2003/000922, filed Nov. 6, 2003, which claims the benefit of U.S. Provisional Application No. 60/425,905, filed Nov. 13, 2002, the contents of each of which are hereby incorporated by reference in their entireties.

This patent disclosure contains material that is subject to copyright protection. the copyright owner has no objection to the facsimile reproduction by anyone of the patent document or the patent disclosure as it appears in the U.S. Patent and Trademark Office patent file or records, but otherwise reserves any and all copyright rights.

All patents, patent applications and publications cited herein are hereby incorporated by reference in their entirety. The disclosures of these publications in their entireties are hereby incorporated by reference into this application in order to more fully describe the state of the art as known to those skilled therein as of the date of the invention described and claimed herein.

FIELD OF THE INVENTION

The present invention relates to the use of Inkjet Printing and other spraying techniques for providing a suitable opaque under-layer on transparent plastic surfaces such as those of the walls of a bottle, over a limited and defined area onto which ink jet inks can be printed to enable the production of color fidelity and large color gamut of the ink jet inks.

BACKGROUND OF THE INVENTION

In ink jet systems, each drop is accurately placed on the printed substrate. The accuracy is achieved by a number of different techniques like continuous spray Inkjet and drop on demand Inkjet.

The method of Inkjet printing places certain restraints on the type and composition of inks that may be used. For instance, it is very difficult to use inks that have abrasive pigments such as metallics or titanium dioxide. Also, inks must have relatively low viscosities (generally less than approximately 30 centipoises) at the point of jetting. Thirdly, the presence of binding polymer is limited as it may cause tailing. In addition, inks containing cross-linking agents could cause blocking of the jet orifices.

Such inks, that are not useable for inkjet, are still useable in other printing technologies such as offset and flexography and in painting technologies such as airbrush, which yield less accurate results than the printing technologies.

When attempting to operate an ink jet printer to print transparent process colors on a non-white surface, a major problem is getting the right printed tint, since any substrate coloration over the non-white surface will cause color distortion owing to the transparent nature of process colors.

Current Inkjet printing systems are therefore limited to printing process colors on opaque white backgrounds, or to printing opaque spot colors only, where the large color span of the process colors is not needed.

It is possible for some applications to preprint a white background by using a different printing technology, such as Flexographic printing, but this means that a separate flexographic or other printing plate would have to be prepared and the substrate run through the printing press as a different process. In addition, objects printed by Inkjet printing may be of a variety of shapes, taking advantage of the fact that Inkjet is a non-contact printing technology, capable of printing on e.g. printing fragile surfaces. Inkjet also has the ability to print variable information and would not be suitable for all types of contact print surfaces. If the shape of the area printed by inkjet is pre-set, some of the variable information advantages of the inkjet are lost. Also, if the white tint layer is printed in a different machine than the Inkjet printer, severe color registration problems may be faced, as in applications where the white tint is only placed at the same location where the images are later located, the exact location of the white image needs to be identified by the Inkjet machine. In addition, contact printing of the white under-layer can only be done if the surface is of a regular shape.

There is need for an apparatus and method for printing an opaque white undercoat by spray or inkjet onto any flat or curved surface, wherein the shape of the white undercoat matches accurately the shape of the color image to be printed thereon.

SUMMARY OF THE INVENTION

In one aspect of the present invention there is provided a method of producing an accurately positioned white layer to serve as an undercoat for inkjet process colors imaging on a substrate, comprising the steps of:

accurately ink jetting a colorless loosely-bonded frame onto the substrate, said frame defining an area to be imaged; and ink jetting or spraying a white layer, said white layer at least partially overlapping said frame and said white layer covering said area defined by said frame.

In one embodiment the method additionally comprises the step of drying said white layer.

In another embodiment the method additionally comprises the step of removing said overlapping parts of said white layer and said frame.

In yet another embodiment, the step of removing comprises rubbing or washing.

In an additional embodiment the method additionally comprises the step of imaging said white layer with ink jet inks.

In another embodiment the colorless ink is oil based.

In another aspect of the present invention there is provided an apparatus for producing an accurately positioned white layer to serve as an undercoat for inkjet process colors imaging on a substrate, comprising: a first inkjet or inkjet array adapted for accurate printing; and a second inkjet or spraying means, wherein said first inkjet or inkjet array is operable to accurately ink jet a colorless loosely-bonded frame onto the substrate, said frame defining an area to be imaged; and wherein said second inkjet or spraying means is operable to ink jet or spray a white layer, said white layer at least partially overlapping said frame and said white layer covering said area defined by said frame.

In one embodiment the apparatus additionally comprises drying means.

In another embodiment the apparatus additionally comprises rubbing or washing means.

In yet another embodiment the first inkjet or inkjet array is additionally operable to inkjet an image onto said white layer.

DETAILED DESCRIPTION OF THE PREFERRED EMBODIMENTS

The present invention is directed to an apparatus provided with:

- an inkjet or inkjet array for inkjet printing a color image on a substrate and also used for printing a frame, as will be described in details below;
- one or more ink jet orifices or non-Inkjet spraying mechanism such as an airbrush, for applying a white undercoat to the substrate. If ink jet is used, then the ink jet orifices are at least 100 microns in diameter to permit the use of inks containing white pigments such as barium sulfate or preferably titanium dioxide. The white undercoat, namely the coating on the plastic substrate onto which the ink jet image of colored and/or black inks are jetted is applied by ink jet or spray to a limited area, which at least covers the ink jet colored and/or black ink area; and
- a washing or wiping system for removing the excess white undercoat.

Figure 1:
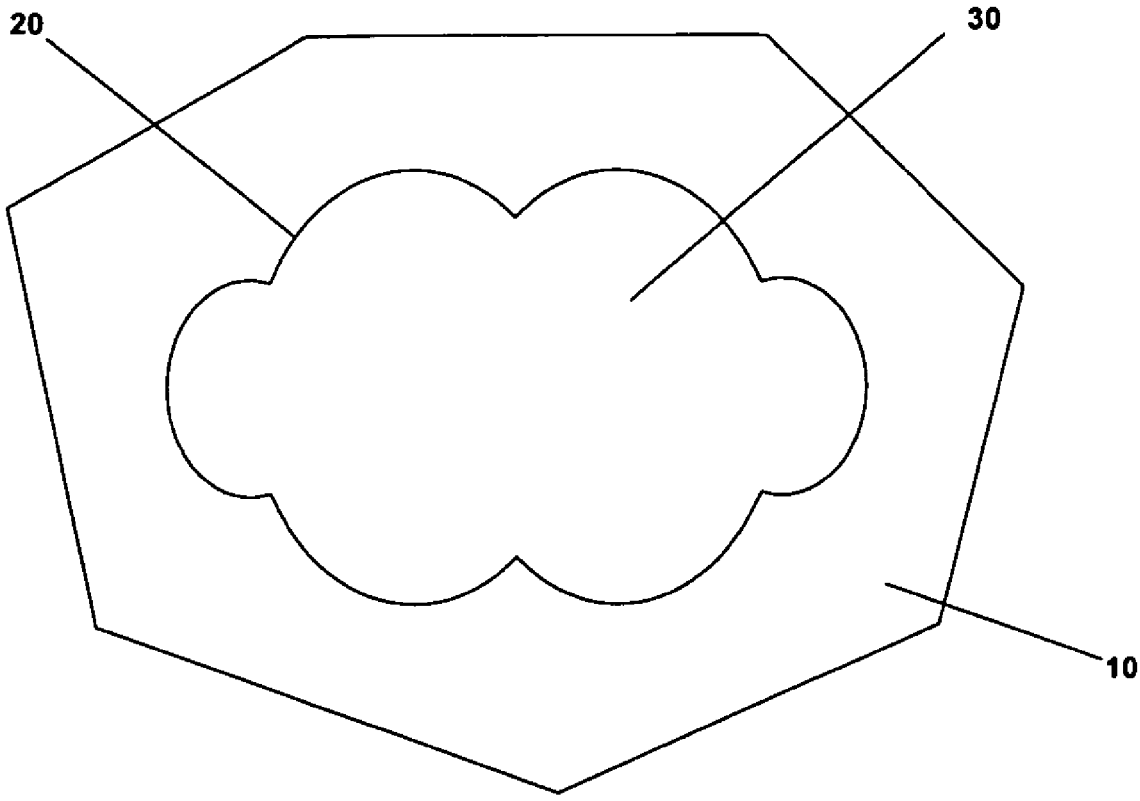
FIG. 1 is a schematic drawing of the accurate frame inkjetted according to the present invention.
Figure 2:
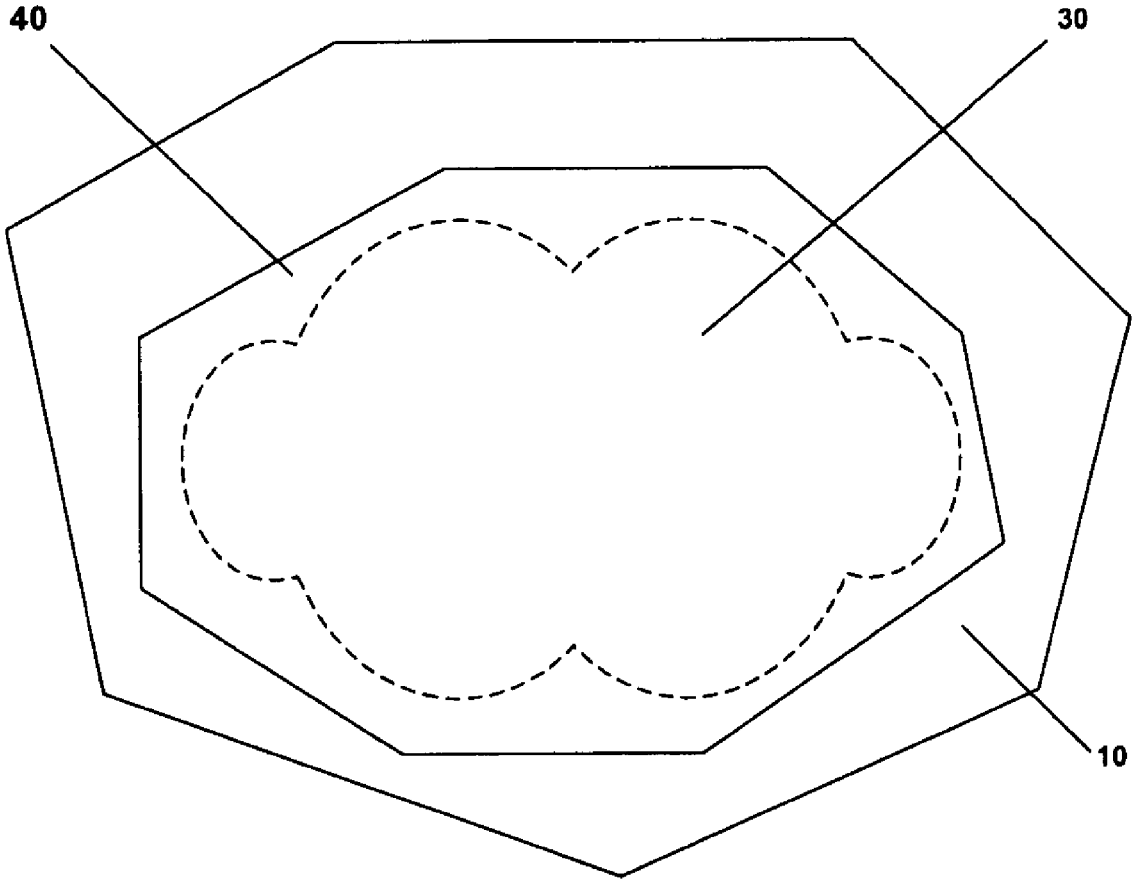
FIG. 2 is a schematic drawing of the white layer sprayed over the area to be imaged and partially overlapping the white frame, according to the present invention.
Figure 3:
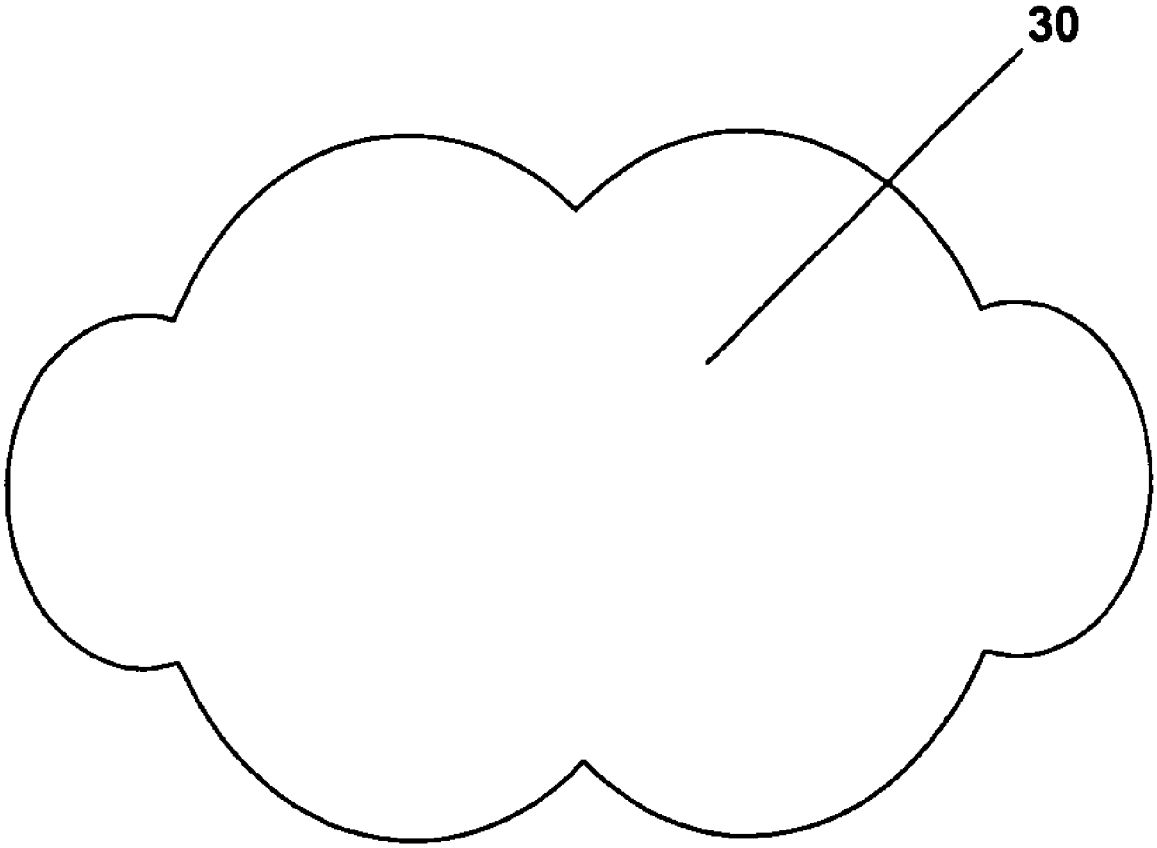
FIG. 3 is a schematic drawing of the accurate white layer resulting from the application of the present invention.

The method of accurately printing a white background prior to inkjet printing with process colors comprises the following steps:

1. As depicted in FIG. 1, an inkjet or inkjet array is used to print a frame 10 around an accurate inner boundary 20, designating the boundary of the required white background area 30. The "ink" used for this operation is inkjet compatible and is either washable from the printed substrate or not attachable by the white printing substance. Preferably, the ink is oil-based rather than water-based to provide good coating on plastic surfaces and is devoid of all coloration.
2. As depicted in FIG. 2, white printing substance 40, such as an opaque white Titanium Oxide based ink, is sprayed or ink jetted over the designated area 30. No special accuracy is required at this stage. The white print should cover the entire area 30 and may overlap the frame 10 (40). The sprayed material should attach itself to the substrate, so that it will not be washable later.
3. The printed area is dried by any available drying system.
4. The printed area is either washed by any means known in the art, such as wet sponge roller or rubbed off with a cloth and the white material on the frame gets washed away along with the frame ink, while the desired, accurately shaped background 30 stays attached to the substrate (FIG. 3).

In order to illustrate the method, a strip of Cellotape was stuck to the surface of a 175-micron polyester sheet. The Cellotape formed a protective mask on selective area of the polyester surface. An oil based black inkjet ink was coated by means of wire-wounded rod to give a 4 micron wet film. It was dried in the oven at 140° Celsius. The Cellotape mask was then removed so that selected areas of the polyester surface were exposed and other areas were covered with black ink. The exposed areas served as simulation for the area to be imaged.

A formulation consisting of the following parts by weight was made up:

Cymel 385 9.62
Water 6.70
Kronos 2063 titanume dioxide 6.28
Hordaphos MOD 0.51

This mixture was milled in a ball mill for one hour and then coated to a 4 micron wet thickness on the polyester with the ink described above. The coated polyester was dried in the oven at 140° Celsius for 4 minutes. The surface was then rubbed with dry cloth. Where the white coating was directly on the oil-based ink it was removed easely. Where it was on the uncoated polyester surface (where the Cellotape had previously been) it could not be removed. The opaque white area could then be used as a color Inkjet receptive area.

The method described herein is particularly applicable to plastic bottle decoration and to the uses of continuous ink jet imaging which lends itself to imaging onto highly uneven surfaces.

The invention claimed is:

1. A method of producing an accurately positioned white layer to serve as an undercoat for inkjet process colors imaging on a substrate, comprising the steps of:

accurately ink jetting a colorless loosely-bonded frame onto the substrate, said frame defining an area to be imaged; and ink jetting or spraying a white layer, said white layer at least partially overlapping said frame and said white layer covering said area defined by said frame.

2. The method of claim 1, additionally comprising the step of drying said white layer.

3. The method of claim 2, additionally comprising the step of removing said overlapping parts of said white layer and said frame.

4. The method of claim 3, wherein said removing comprises rubbing or washing.

5. The method of claim 3, additionally comprising the step of imaging said white layer with ink jet inks.

6. The method according to claim 1, whereby the colorless ink is oil based.

7. Apparatus for producing an accurately positioned white layer to serve as an undercoat for inkjet process colors imaging on a substrate, comprising:

a first inkjet or inkjet array adapted for accurate printing; and a second inkjet or spraying means, wherein said first inkjet or inkjet array is operable to accurately ink jet a colorless loosely-bonded frame onto the substrate, said frame defining an area to be imaged; and wherein said second inkjet or spraying means is operable to ink jet or spray a white layer, said white layer at least partially overlapping said frame and said white layer covering said area defined by said frame.

8. The apparatus of claim 7, additionally comprising drying means.

9. The apparatus of claim 7, additionally comprising rubbing or washing means.

10. The apparatus of claim 7, wherein said first inkjet or inkjet array is additionally operable to inkjet an image onto said white layer.

* * * * *